United States Patent [19]

Wada

[11] Patent Number: 4,642,054

[45] Date of Patent: Feb. 10, 1987

[54] PICTURE BOOK HAVING A TELEPHONE DIAL THEREIN

[76] Inventor: Yoshiomi Wada, 3-53-10, Higoshi Oizumi-machi Nerima-ku, Tokyo, Japan

[21] Appl. No.: 713,251

[22] Filed: Mar. 18, 1985

[51] Int. Cl.[4] ..... G09B 19/00

[52] U.S. Cl. ..... 434/178; 446/141; 434/365; 434/404

[58] Field of Search ..... 434/178, 365, 167, 219, 434/404; 446/141, 151

[56] References Cited

U.S. PATENT DOCUMENTS

| | | | |
|---|---|---|---|
| 2,693,362 | 11/1954 | Ford | 446/141 X |
| 2,907,123 | 10/1959 | McMahon | 434/167 |
| 2,917,325 | 12/1959 | Sines | 434/365 X |
| 3,918,180 | 11/1975 | Chamberlin | 434/178 |
| 4,537,576 | 8/1985 | Thorsheim et al. | 434/404 |

*Primary Examiner*—William H. Grieb

*Attorney, Agent, or Firm*—Mason, Kolehmainen, Rathburn & Wyss

[57] ABSTRACT

A picture book comprising the front and back covers and further a plurality of printed paper sheets therebetween, characterized in that said front cover and paper sheets have each window cut in aligned positions, and in that a telephone structure is attached on the inside surface of said back cover so that the dial is always appearing in said windows.

7 Claims, 7 Drawing Figures

PICTURE BOOK HAVING A TELEPHONE DIAL THEREIN

FIELD OF THE INVENTION

The present invention relates to picture books, especially to such books sometimes known as "toy books" comprising a telephone dial structure therein to provide an improved form of picture book which always show such dial in any open position of the book.

SUMMARY OF THE INVENTION

According to the main feature of the present invention, the book comprises front and back covers and further printed paper leaves therebetween, and a telephone dial structure is attached on the inside surface of the back cover. The front cover and all leaves are formed of openings or windows cut in the aligned positions to said dial structure. Therefore the dial structure is always appearing in any open position of the book.

BACKGROUND OF THE INVENTION

Children or infants are essentially interested in a telephone and like to behave as if they are actually talking by a telephone. Up to the present day, there have been manufactured or proposed many kinds of telephone toys which all are in imitation of real telephones and have their large volume. Infants who do not know how to use a telephone toy, can not enjoy talking to others with it, and it is therefore necessary to teach them the usage for a few minutes. In such a case, infants usually wants to be taught, hearing a joyous or happy story and also wants to use a telephone toy like a hero or heroine does in the story. However, at present, there is none of toys suitable to such a way as to teach infants how to use a telephone while an adult tells them a joyous story.

Therefore, an object of the present invention is to provide a picture book having a telephone dial therein which are useful to teach infants the usage of a telephone while they are hearing a joyous story.

Another object of the invention is to provide a picture book which has a small and planar dial structure so attached thereto that a dial is always appearing in any open position of the book.

Still another object of the invention is to provide a picture book having a telephone dial structure which is portable and easily handled by children.

Still further object of the invention is to provide a picture book having a telephone dial structure which can be used to make children perfectly master how to use a telephone with a practical explanation on telephone calls in a happy story.

The foregoing and other objects and advantages of the present invention will be apparent with the following explanation on a preferred embodiment of the invention.

PREFERRED EMBODIMENT OF THE INVENTION

Figure 1:
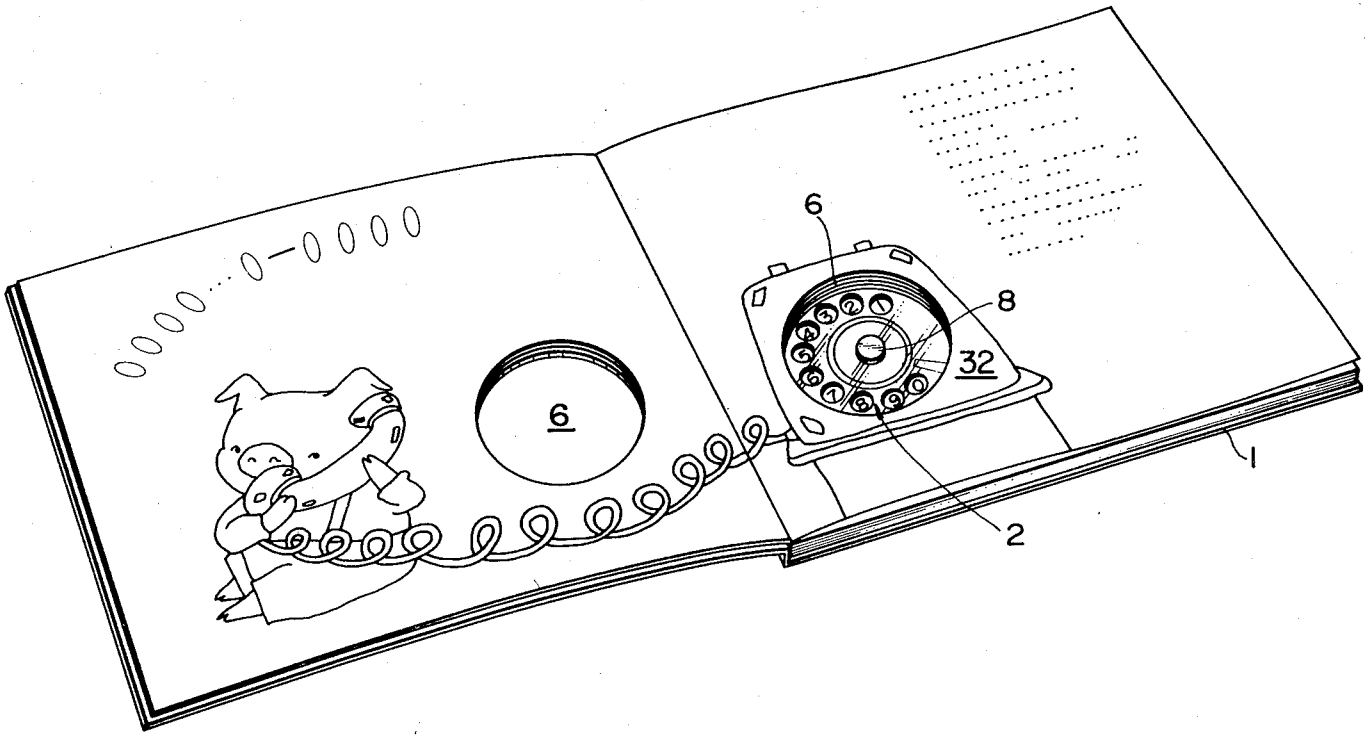
Figure 2:
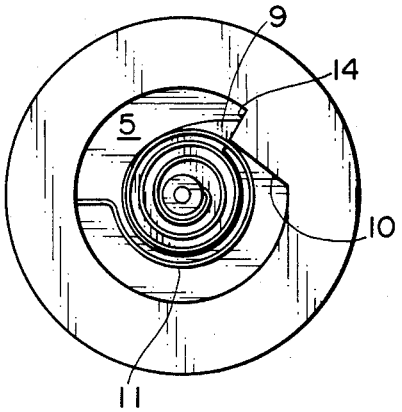
Figure 3:
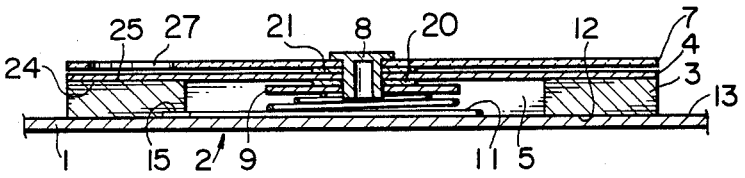
Figure 4:
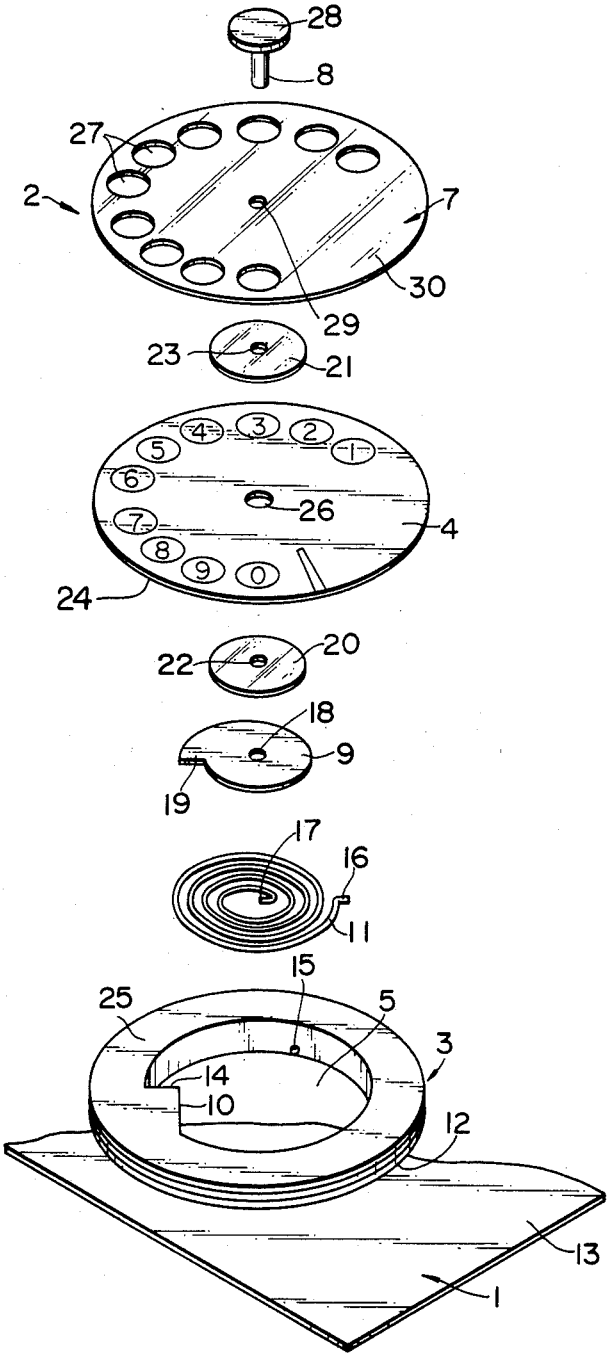
Figure 5:
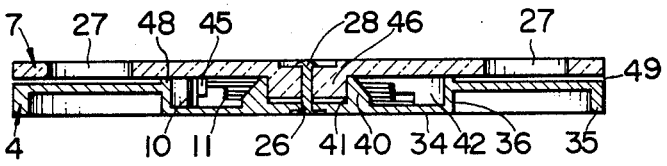
Figure 6:
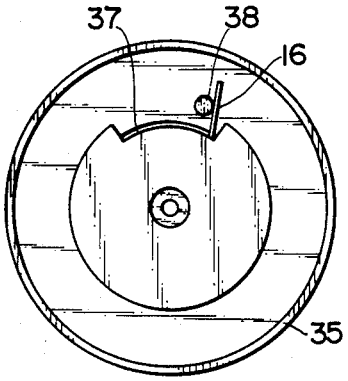
Figure 7:
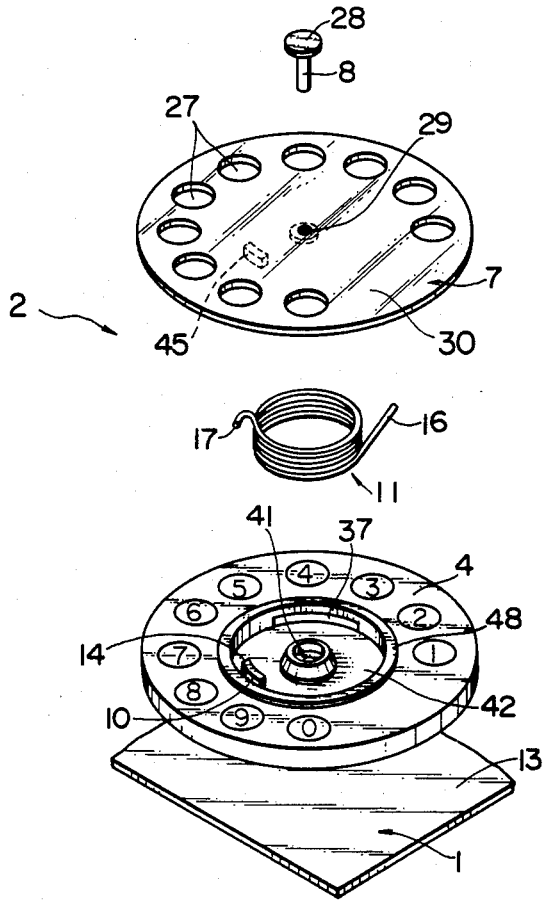

One embodiment of the present invention will now be described in the following explanation in connection with the accompanying drawings: wherein FIG. 1 shows a perspective view of a picture book in an open position; FIG. 2 is a back plan view of the telephone dial structure before attachment thereof to the back cover; FIG. 3 is an enlarged central section of the dial structure; FIG. 4 is an exploded view of the dial structure; FIG. 5 is an enlarged central section of the dial structure in another embodiment of the invention; FIG. 6 is a bottom view of the dial structure shown in FIG. 5; and FIG. 7 is an exploded view thereof.

Referring to FIGS. 1 and 3 a telephone dial structure 2 is fixed on the inside surface 13 of the back cover 1 of a picture book. In detail, as shown in FIGS. 2, 3 and 4, dial structure 2 comprises a base plate 3 provided with a central opening 5. Base plate 3 is generally made of a plurality of stacked paper boards and its bottom surface 12 is secured to inside surface 13 of the back cover 1. Base plate 3 is also provided integrally with a protrusion 10 projecting inward the central opening 5 to form an abutment surface 14.

A spiral spring 11 is positioned within the central opening 5 and an outer end 16 of the spring 11 is rigidly connected to an aperture 15 formed in the base plate 3. In the dial structure according to the present invention, a spiral spring 11 is useful to make a thin structure. Above the spring 11, a stopper 9 is provided having a pawl 19 engageable with the abutment surface 14 of base plate 3. A stopper is drilled to form a hole 18 through which a shaft 8 is inserted. Above the stopper 9, a spacer 20, a dial plate 4, another spacer 21 and a rotatable finger plate 7 are in turn arranged in alignment. Spacers 20 and 21 have their central holes 22 and 23 respectively to receive shaft 8. The dial plate 4 is printed with numerical symbols from 1 to 0 and if desired with other necessary design. Bottom surface 24 of the dial plate 4 is secured to upper surface of the base plate 3 so that the dial plate 4 can not be rotated.

Dial plate 4 is also provided with a relatively large hole 26 so as to freely rotate shaft 8 in hole 26. The rotatable finger plate 7 preferably made of a transparent material such as one of synthetic resins is formed of a plurality of holes 27 in spaced circumferential positions each corresponding to the numerical symbol in dial plate 4 so that the numerical symbols appear within holes 27. Finger plate 7 has a central hole 29 through which the shaft 8 passes.

Shaft 8 is formed of an enlarged end or flange 28 facing and contacting with the upper surface 30 of finger plate 7. Shaft 8 is preferably hollow and made of a soft metal for swaging or flaring attachment. In assembling, shaft 8 is inserted into holes 29, 23, 26, 22 and 18, and the lowermost end of shaft 8 is swaged so that by the swaged end, the inner end 17 of spiral spring 11 is fixed to stopper 9 which is in a tensioned condition by spiral spring 11 and the pawl 19 engages with abutment surface 14. Under the circumstances, when finger plate 7 is turned by finger against the torsional elasticity of spiral spring 11, finger plate 7 is rotated with shaft 8 and stopper 9 while hole 26 of dial plate 4 permits free rotation of the shaft 8.

When finger plate 7 is turned up to about 300 degrees, the contact between pawl 19 and protrusion 10 bars further rotation of finger plate 7. When the finger is released from the plate 7, it is automatically returned by the spiral spring 11 to the original position where pawl 19 is engaged with abutment surface 14. As apparent from the foregoing, plate 7 may be rotatably operated in a similar way to a real telephone dial.

As shown in FIG. 1, the front cover and all leaves of papers are formed of respective openings or windows 6 at a position aligned to the dial structure 2, so that the dial always appears within window 6 in any open position of the book. Preferably, as shown in the right side of FIG. 1, a telephone picture 32 may be printed around window 6. Also, any character and suitable conversion sentences may be printed on the whole pages of the book which will arouse children interest.

FIGS. 5 to 7 show another embodiment of the invention which has a very simple construction by removal of the above-mentioned base plate 3 and stopper 9. Dial plate 4 illustrated in FIG. 5 is provided with a peripheral edge 35 and cup-like portion 36 at the center both extending downwardly. The cup-like portion 36 is cut to form a notch 37 which passes through the plate 4. A lug 38 (FIG. 6) is formed extending downwardly from the downward surface of the plate 4 between the peripheral edge 35 and notch 37. Inside of the cup-like portion 36, a protrusion 10 is provided having an abutment surface 14 in an eccentric position from the center of the palte 4. Also, the cup-like portion 36 includes a boss 40 having a concavity 41.

The cup-like portion 36 defines a cavity 42 wherein a coil spring 11 is positioned. The outer end 16 of spring 11 passes through the notch 37 and is engaged with the lug 38 for fixation, and the bent inner end 17 is securely attached to a stopper 45 which is integrally formed in and extends downwardly from the finger plate 7. The stopper 45 is positioned in substantially equal distance from the central axis of the plate 7 to that between the protrusion 10 and central axis of the plate 4 so that stopper 45 is engageable with the abutment surface 14.

The plate 7 includes a central projection 46 having its diameter a little less than that of concavity 41 of the plate 4. In assembling, the spring 11 is positioned within cavity 42 surrounding the boss 40, and the outer and inner ends 16, 17 thereof are respectively engaged with lug 38 and stopper 45. Under the tensioned condition of the spring 11 and thereby contacted conditioned of stopper 45 and abutment surface 14, the projection 46 is put into the concavity 41, and then shaft 8 is inserted into holes 29 and 26 of the plates 7 and 4. The lower end of shaft 8 is swaged to prevent detachment thereof. The bottom surface 34 of the plate 4 is rigidly attached on the back cover 1 of a book.

Similarly to the foregoing, by a finger, the finger plate 7 is rotatable about the shaft 8 against the torsional elasticity of spring 11 up to about 300 degrees. After contact between stopper 45 and protrusion 10, when the finger is released from the plate 7, it is automatically returned by the spring 11 to the original position where stopper 45 is engaged with abutment surface 14. For smooth rotation of the plate 7 on the plate 4, an annular axial projection 48 is provided at the top of the cup-like portion 36 to form a little gap 49 between the plates 4 and 7.

In the picture book according to the present invention, a person can sufficiently teach children the usage of telephone while he/she tells them a joyous story and they can promptly and happily learn it. Since the dial structure is attached to the inside surface of the back cover, infants may easily carry and handle the book.

I claim:

1. A picture book comprising front and back covers, and further a plurality of printed paper sheets therebetween, characterized in that a telephone dial structure is attached on the inside surface of said back cover, and that said dial structure comprises a dial plate attached on said back cover, said dial plate bearing numerical symbols and provided with a hole, said dial plate including an abutment surface, a finger plate formed of a plurality of holes in spaced circumferential positions each aligned to said numerical symbol, a shaft received within holes of said dial and finger plates to permit rotation of said finger plate, a stopper rigidly connected to said finger plate and engageable with said abutment surface formed in said dial plate, and a spring arranged between said finger plate and dial plate for urging said stopper toward said abutment surface.

2. A picture book as defined in claim 1, one of said dial or finger plates having at least an axial projection to form a gap between said dial and finger plates.

3. A picture book as defined in claim 2, said axial projection is annular.

4. A picture book as defined in claim 1, said dial plate being provided integrally with a protrusion to form said abutment surface.

5. A picture book as defined in claim 1 said spring being positioned within a cavity of said dial plate.

6. A picture book as defined in claim 1, said book includes a telephone picture around the window in each leaf of the book.

7. A picture book as defined in claim 1, said book includes a character and conversation sentences printed on each leaf of the book.

* * * * *